US009634432B2

(12) United States Patent
Su et al.

(10) Patent No.: US 9,634,432 B2
(45) Date of Patent: Apr. 25, 2017

(54) HIGH FREQUENCY CONNECTOR WITH ENHANCED GROUNDING FOR REDUCED CROSSTALK

(71) Applicant: NEXTRONICS ENGINEERING CORP., New Taipei (TW)

(72) Inventors: Hou-An Su, Keelung (TW); Chi-Jung Chan, New Taipei (TW); Hung-Wei Hsu, Taipei (TW)

(73) Assignee: NEXTRONICS ENGINEERING CORP., New Taipei (TW)

( * ) Notice: Subject to any disclaimer, the term of this patent is extended or adjusted under 35 U.S.C. 154(b) by 0 days.

(21) Appl. No.: 14/874,000

(22) Filed: Oct. 2, 2015

(65) Prior Publication Data

US 2017/0025794 A1 Jan. 26, 2017

(30) Foreign Application Priority Data

Jul. 22, 2015 (TW) ..... 104211825 U

(51) Int. Cl.

| | |
|---|---|
| ***H01R 24/64*** | (2011.01) |
| ***H01R 13/6461*** | (2011.01) |
| ***H01R 13/6582*** | (2011.01) |
| *H01R 107/00* | (2006.01) |

(52) U.S. Cl.

CPC ..... *H01R 13/6461* (2013.01); *H01R 13/6582* (2013.01); *H01R 24/64* (2013.01); *H01R 2107/00* (2013.01)

(58) Field of Classification Search

CPC . H01R 13/65802; H01R 12/73; H01R 13/652

USPC ..... 439/95, 607.28, 939, 607.17, 607.2, 439/607.21, 637, 108

See application file for complete search history.

(56) References Cited

U.S. PATENT DOCUMENTS

| | | | | |
|---|---|---|---|---|
| 6,074,225 A * | 6/2000 | Wu | H01R 23/6873 | 439/101 |
| 6,926,565 B2 * | 8/2005 | Fogg | H01R 12/721 | 439/862 |
| 7,044,777 B1 * | 5/2006 | Daly | H01R 23/6873 | 439/540.1 |
| 7,625,240 B2 * | 12/2009 | Hayden, Sr. | H01R 13/64 | 439/637 |

(Continued)

*Primary Examiner* — Tulsidas C Patel
*Assistant Examiner* — Marcus Harcum
(74) *Attorney, Agent, or Firm* — Li & Cai Intellectual Property (USA) Office

(57) ABSTRACT

A high frequency connector with enhanced grounding for reduced crosstalk includes an insulative main body, a plurality of first terminals and second terminals, a back cover and a grounding member. The first terminals and the second terminals are disposed in the insulative main body, the back cover is provided at the second end of the insulative main body. The back cover is formed with an opening and capable of preventing the first terminals from being detached from the insulative main body. The grounding member has a body portion and contact sprint portion, the body portion is disposed inside the insulative main body and located between the first terminals and second terminals. The contact spring portion extends outward from the insulative main body and contacts the metal case of a mating plug connector for reducing crosstalk and restraining electromagnetic interference.

7 Claims, 10 Drawing Sheets

(56) References Cited

U.S. PATENT DOCUMENTS

| | | | | |
|---|---|---|---|---|
| 7,833,068 | B2 * | 11/2010 | Bright | H01R 13/502 439/733.1 |
| 8,167,631 | B2 * | 5/2012 | Ito | H01R 24/38 439/108 |
| 8,328,565 | B2 * | 12/2012 | Westman | H01R 12/724 439/108 |
| 8,764,488 | B2 * | 7/2014 | Zeng | H01R 13/6585 439/108 |
| 8,944,863 | B1 * | 2/2015 | Yang | H01R 13/6585 439/607.08 |
| 9,263,835 | B2 * | 2/2016 | Guo | H01R 13/6596 |
| 9,397,427 | B2 * | 7/2016 | Ho | H01R 12/721 |
| 2006/0009080 | A1 * | 1/2006 | Regnier | H01R 12/725 439/637 |
| 2006/0014438 | A1 * | 1/2006 | Regnier | H01R 12/721 439/637 |
| 2009/0124124 | A1 * | 5/2009 | Huang | H01R 13/65802 439/607.02 |
| 2010/0233910 | A1 * | 9/2010 | Zhang | H01R 12/712 439/626 |
| 2011/0169346 | A1 * | 7/2011 | Evers | H01F 7/066 310/12.04 |
| 2012/0208405 | A1 * | 8/2012 | Wang | H01R 12/716 439/676 |
| 2012/0322313 | A1 * | 12/2012 | Hsu | H01R 13/514 439/629 |
| 2015/0155665 | A1 * | 6/2015 | Su | H01R 13/6477 439/676 |

* cited by examiner

HIGH FREQUENCY CONNECTOR WITH ENHANCED GROUNDING FOR REDUCED CROSSTALK

BACKGROUND OF THE INVENTION

1. Field of the Invention

The present invention is related to a high frequency connector, in particular, to a high frequency connector with enhanced grounding for reduced crosstalk.

2. Description of Related Art

Transceivers are utilized to interconnect circuit cards of communication links and other electronic modules or assemblies. Various international and industry standards define the type of connectors used to connect computers to external communication devices, such as modems, network connectors, and other transceivers. A well-known type of transceiver module developed by an industry consortium and known as a Gigabit Connector Converter (GBIC) provides a connection between a computer and an Ethernet, Fiber Channel, or another data communication environment.

It is desirable to miniaturize transceivers in order to increase the port density at a network connection (at switch boxes, cabling patch panels, wiring closets, computer I/O, etc.). Small form-factor pluggable (SFP) transceiver modules were developed to meet this need. SFP transceivers are less than one half the size of a GBIC transceiver, allowing higher aggregated data throughput in a communication system. However, prior art SFP transceiver module have issues of electromagnetic interference and crosstalk, and the speed of data transmission is difficult to improve.

With reference to FIG. 1, the prior art SFP transceiver module 100 does not contact to the metal case 200 of a mating plug connector (optical transceiver) and therefore cannot be effectively grounded. With reference to FIGS. 2A and 2B, which illustrate a testing connecting and return loss waveform diagram and a testing crosstalk waveform diagram respectively, crosstalk and impulse occurs at 7 GHz.

In summary, the inventor of this instant disclosure has contributed to research and developed a connector of the instant disclosure to overcome the abovementioned drawbacks.

SUMMARY OF THE INVENTION

The object of the instant disclosure is to provide a high frequency connector with enhanced grounding for reduced crosstalk capable of restraining electromagnetic interference, reducing crosstalk and raising the speed of data transmission.

According to one exemplary embodiment of the present invention, a high frequency connector with enhanced grounding for reduced crosstalk includes an insulative main body, the insulative main body has a first end and a second end, a plurality of side walls are disposed between the first and the second end, the insulative main body is formed with an opening slot and a plurality of terminals slots, the opening slot is formed on the side walls and connected the first end and the second end, and the terminal slots are provided at the upper and bottom side of the opening slot. A plurality of first terminals are disposed in the insulative main body and accommodated into the terminal slots. A plurality of second terminals are disposed in the insulative main body and accommodated into the terminal slots. A grounding member includes a body portion and two contact resilient portions; the body portion comprises a central body and two contact resilient portions. Each of the contact resilient portions are formed on two ends of the central body respectively. The body portion of the grounding member is disposed inside the insulative main body and located between the first terminals and the second terminals. Two contact resilient portions are extended outward from the insulative main body.

Preferably, the high frequency connector of the instant disclosure further includes a back cover disposed in the second end of the insulative main body, the back cover envelopes the first terminals, one end of the first terminal is formed with a soldering portion, the soldering portion extends outward from the back cover, and the back cover is formed with an opening.

Preferably, a body portion of the grounding member is disposed inside the opening slot of the insulative main body.

The instance disclosure has the following advantages:

The high frequency connector with enhanced grounding for reduced crosstalk of the instant disclosure has a grounding member, the body portion of the grounding member includes two side walls to contact the printed circuit board of a mating plug connector (e.g. optical transceiver) for realizing the function of positioning and abrasion resistance. In addition, two contact resilient portions of the grounding member are extended outward from the insulative main body and contact the metal case of the mating plug connector (e.g. optical transceiver) so forming a ground connection. The contact resilient portions provide the function of grounding, increase the contact area of the ground connection, restrain electromagnetic interference, reduce crosstalk, and raise the speed of data transmission.

For further understanding of the instant disclosure, reference is made to the following detailed description illustrating the embodiments and examples of the instant disclosure. The description is for illustrative purpose only and is not intended to limit the scope of the claim.

DETAILED DESCRIPTION OF THE PREFERRED EMBODIMENTS

Figure 1:
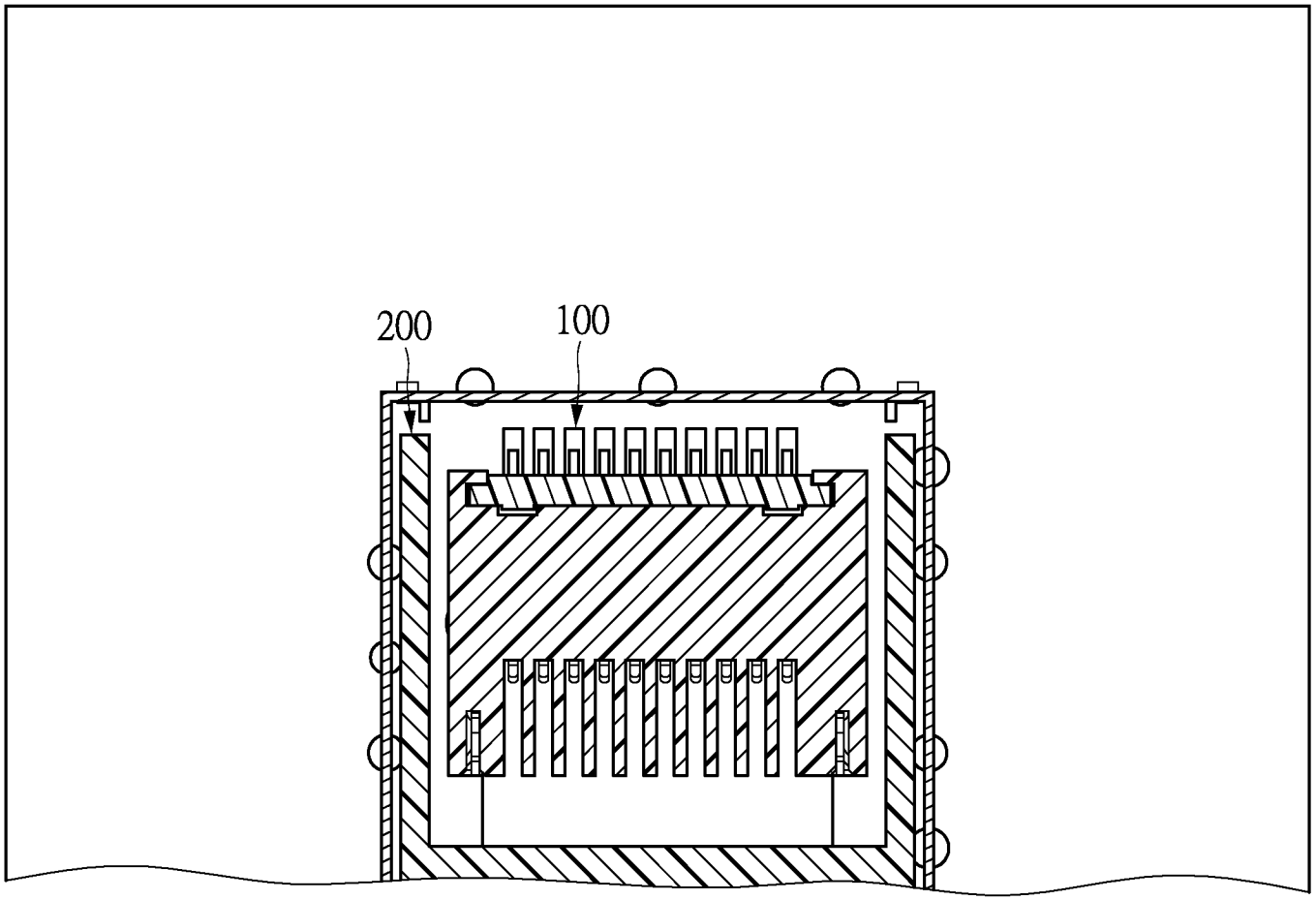
FIG.1(PRIOR ART)
FIG. 1 illustrates a sectional view of a prior art connector connects to a mating plug connector.
Figure 2A:
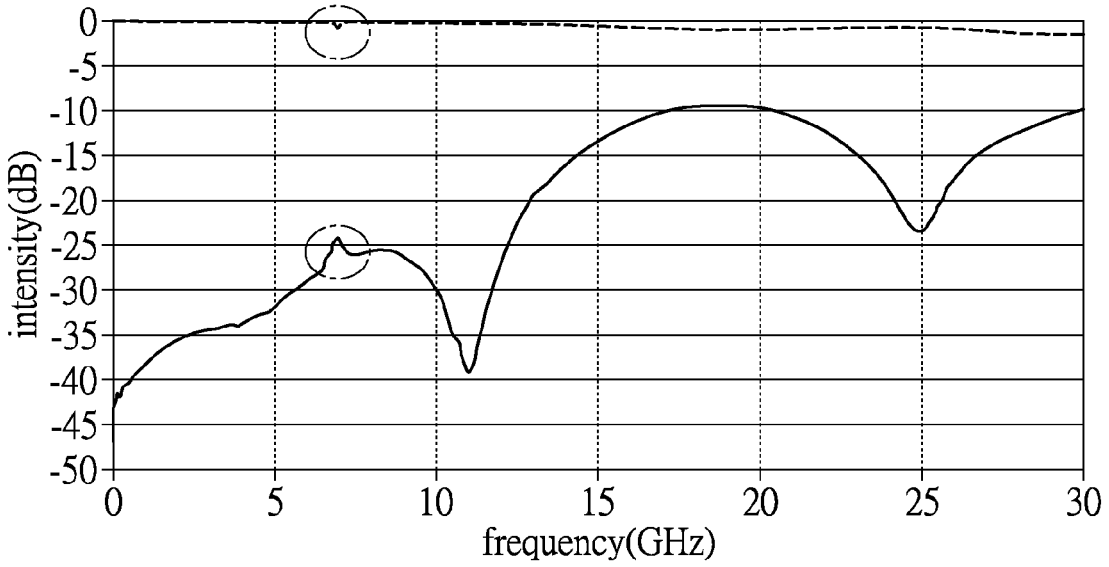
FIG.2A(PRIOR ART)
FIG. 2A illustrates a testing connecting and return loss waveform diagram of prior art connector.
Figure 2B:
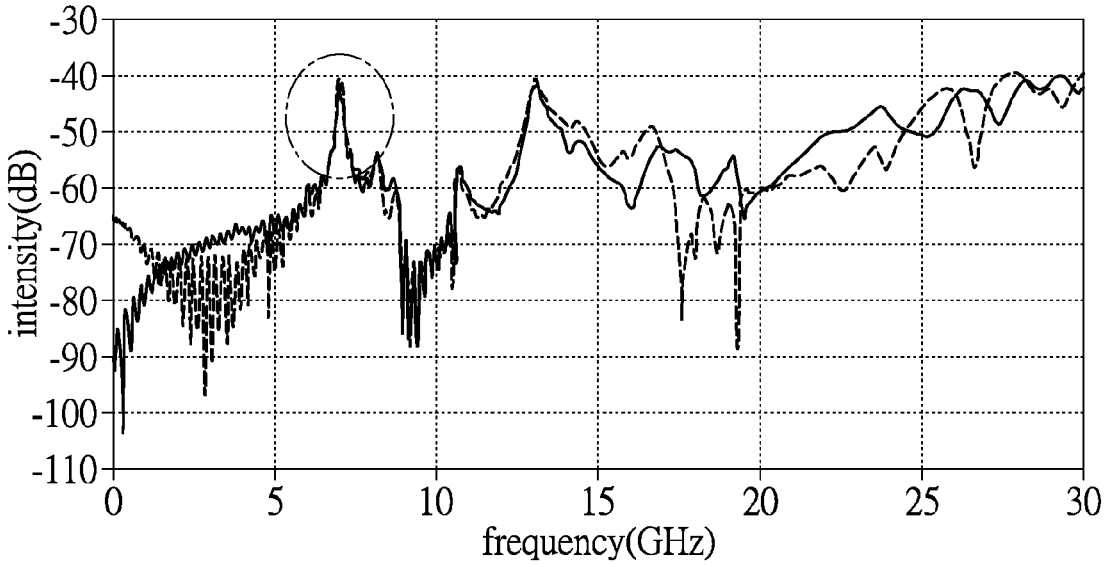
FIG.2B(PRIOR ART)
FIG. 2B illustrates a testing crosstalk waveform diagram of prior art connector.
Figure 3:
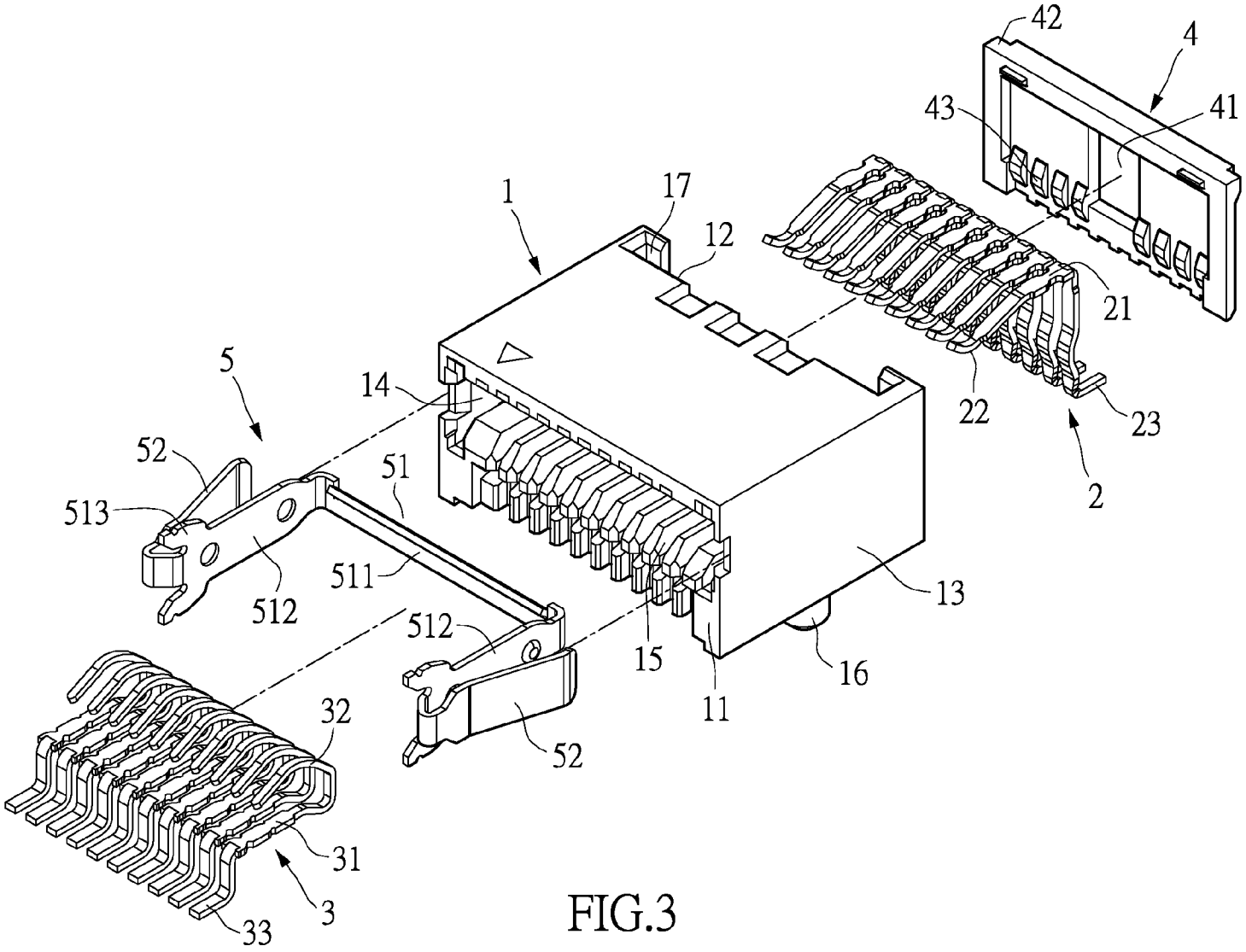
FIG. 3 illustrates a exploded perspective view of a high frequency connector in the instant disclosure.
Figure 4:
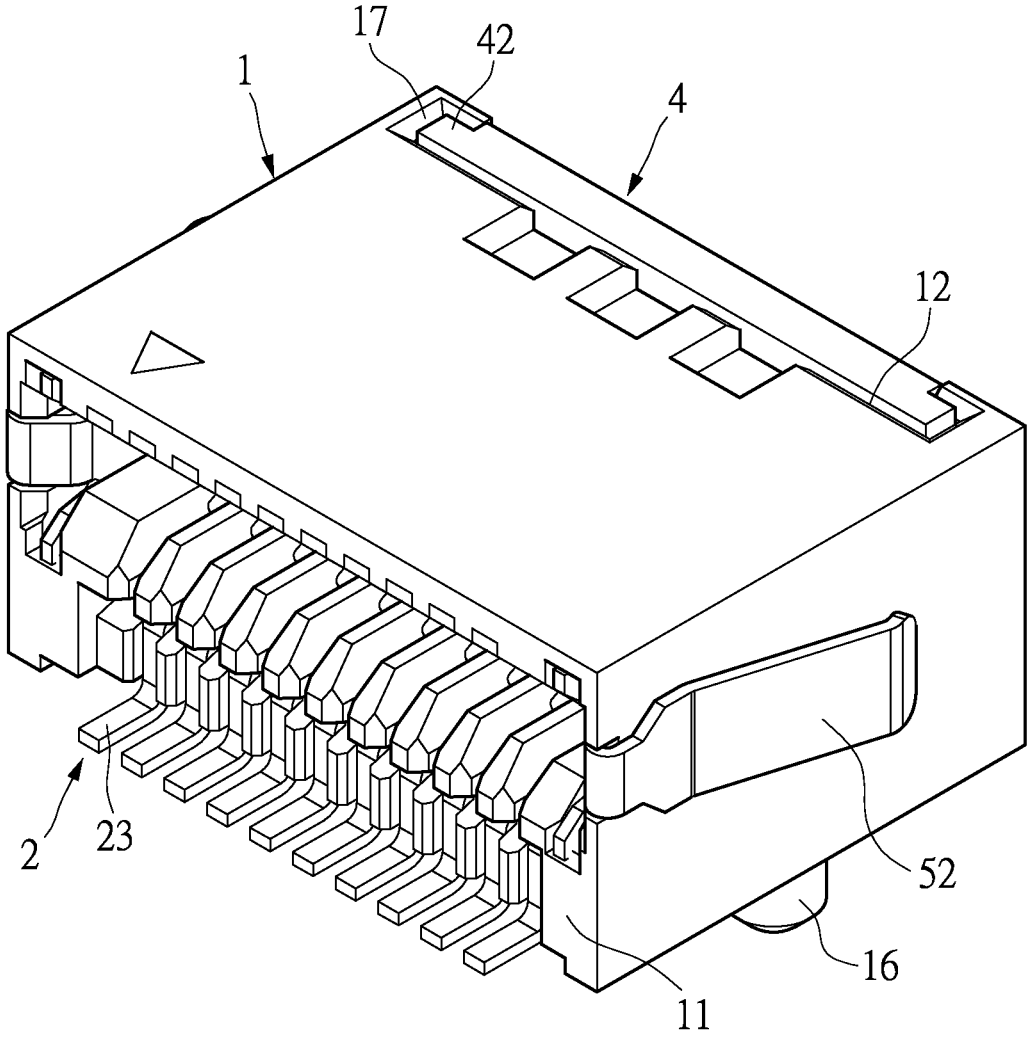
FIG. 4 illustrates a perspective view of a high frequency connector in the instant disclosure.
Figure 5:
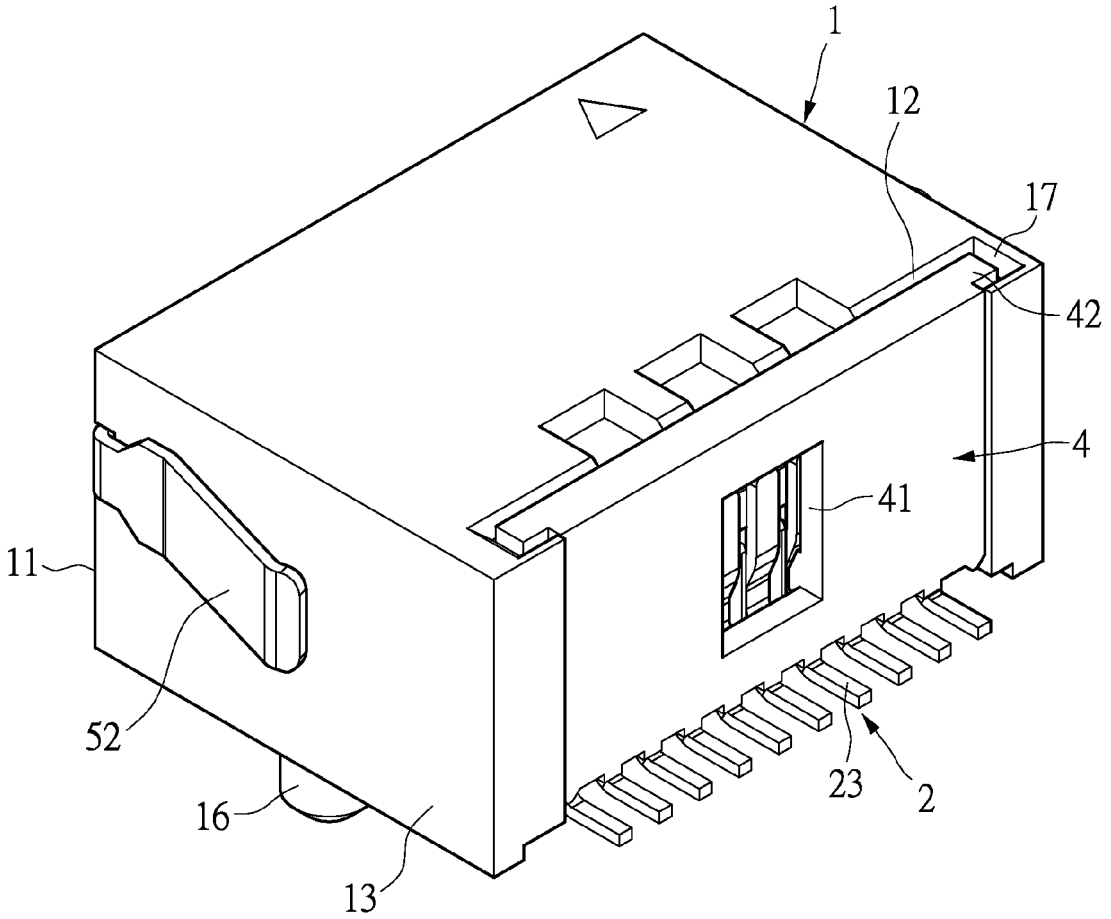
FIG. 5 illustrates another perspective view of a high frequency connector in the instant disclosure.
Figure 6:
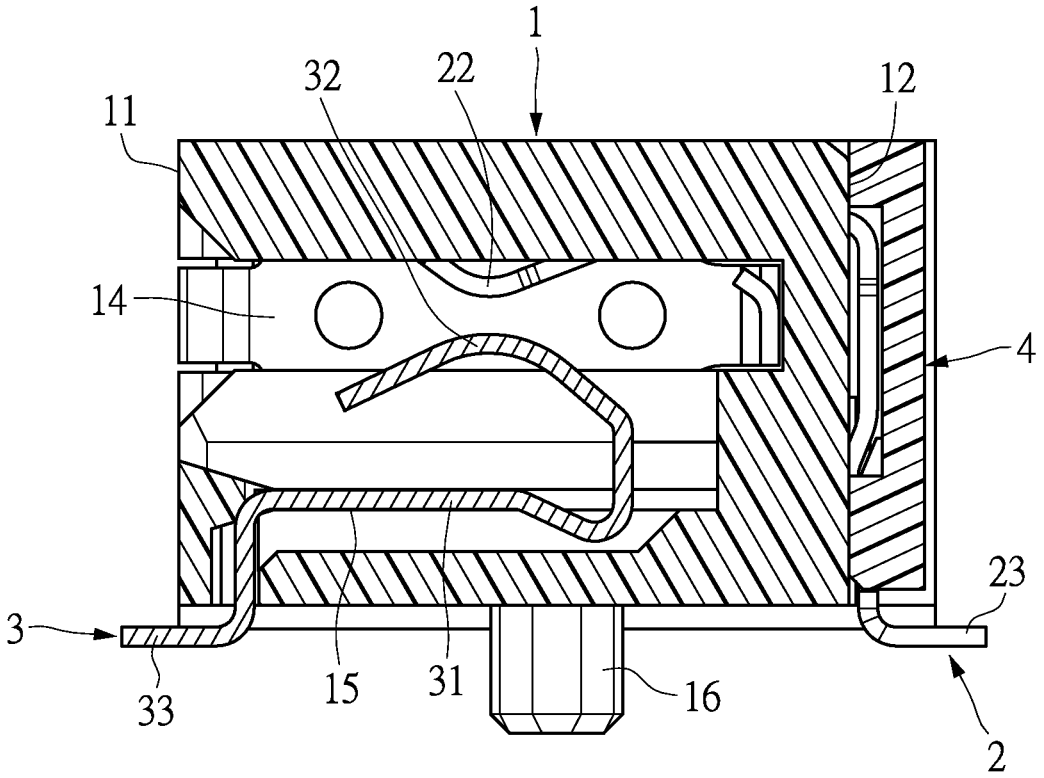
FIG. 6 illustrates a sectional view of a high frequency connector in the instant disclosure.

With reference to FIG. 3-6, the instant disclosure provides a high frequency connector with enhanced grounding for reduced crosstalk, in particular, the instant disclosure relates to a small form-factor pluggable transceiver module meeting an SFP transceiver specification. The high frequency connector of the present invention includes an insulative main body 1, a plurality of first terminals 2, a plurality of second terminals 3, and a grounding member 5.

The insulative main body 1 is made by insulating material (e.g. plastic). The insulative main body 1 has a first end 11, and a second end 12 relative to the first end 11. A plurality of side walls 13 (4 side walls) are formed between the first end 11 and the second 12. The side walls are located in the top, bottom, left, and right side of the insulative main body 1. The insulative main body 1 includes an opening slot 14 and a plurality of terminal slots 15. The opening slot 14 is formed in the side walls 13 and between the first end 11 and the second 12.

The terminal slots 15 are disposed in the upper and bottom side of the side walls 13, in other words, the terminal slots 15 are located in the upper and bottom side of the opening slot 14 and accommodate the first terminals 2 and the second terminals 3. The terminal slots 15 located at the upper and bottom side of the opening slot 14 are arranged in an opposite manner or staggered manner, or in partially opposite or partially staggered manner. In this embodiment, the terminal slots 15 located at the upper and bottom side of the opening slot 14 are arranged in a staggered manner. The bottom side of the insulative main body 1 is formed with one or more locating pillars 16 to insert into the holes (not shown) of the printed circuit board, so the high frequency connector of the present invention is secured to the printed circuit board.

The first terminals 2 and the second terminals 3 are made by electrically conducting metal or alloy materials. The first terminals 2 and the second terminals 3 meet an SFP transceiver specification. Each of the first terminals 2 has a fixed portion 21, a contact portion 22, and a soldering portion. Similarly, each of the second terminals 3 has a fixed portion 31, contact portion 32, and a soldering portion 33. In this embodiment, the contact portions 22, 32 are bended and formed in a spring type. The contact portions 22, 32 are formed at one end of the fixed portions 21, 31 respectively. The soldering portions 23, 33 with a L-shape are formed at another end of the fixed portion 21, 31 respectively. The shape of the first terminals 2 and the second terminals 3 are not limited and could be modified as required.

Figure 7:
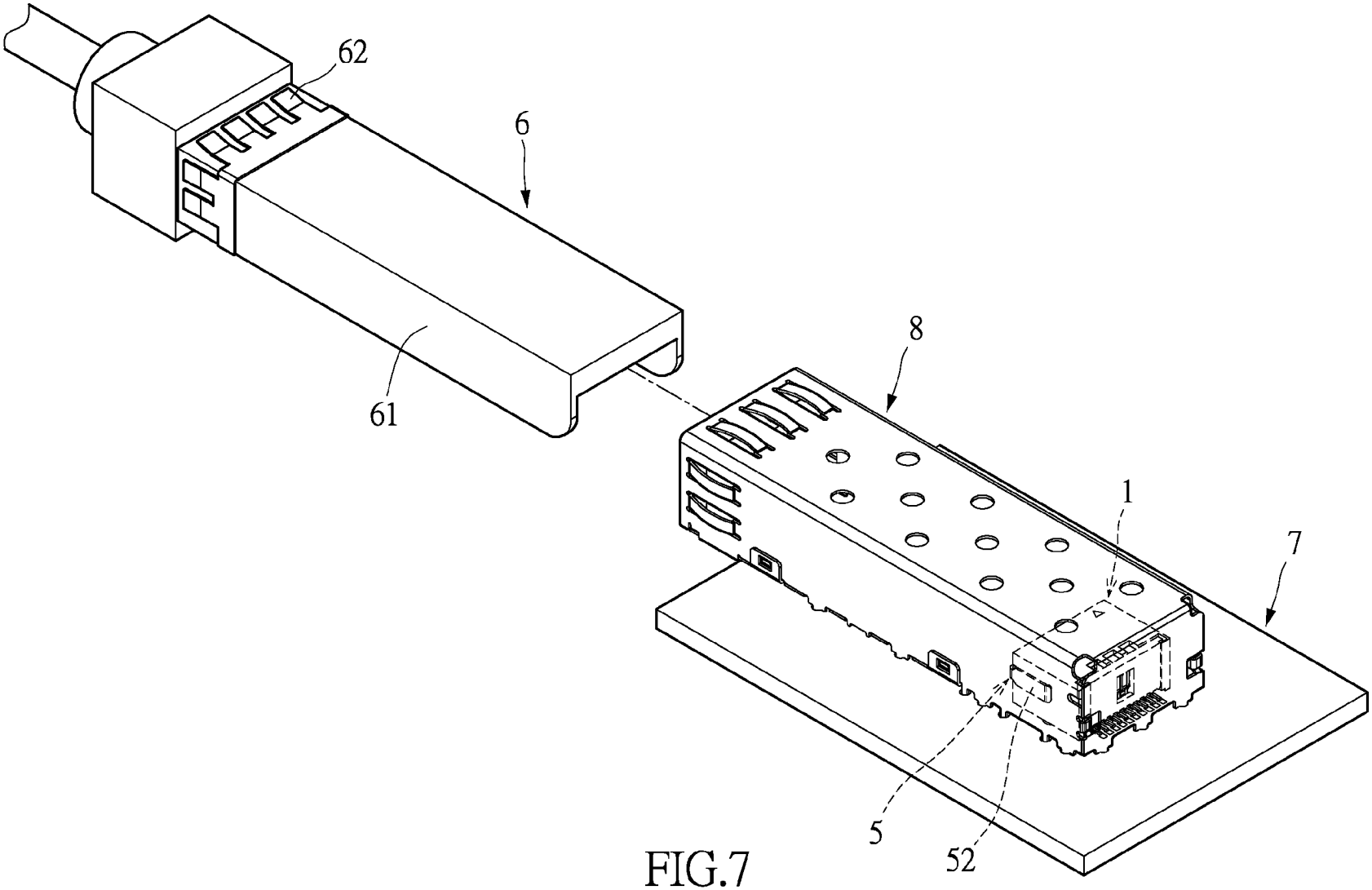
FIG. 7 illustrates a perspective view of a high frequency connector in the instant disclosure detached from a corresponding connector.
Figure 8:
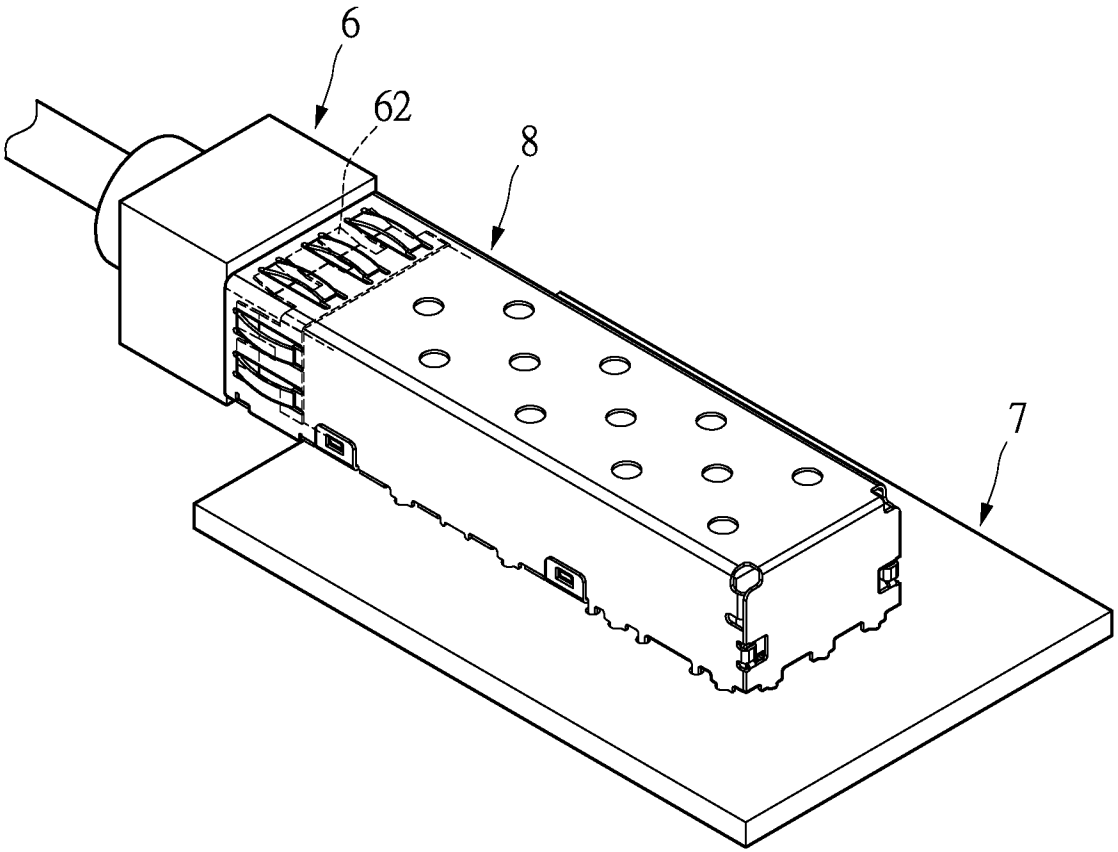
FIG. 8 illustrates a perspective view of a high frequency connector in the instant disclosure connect to a corresponding connector.
Figure 9:
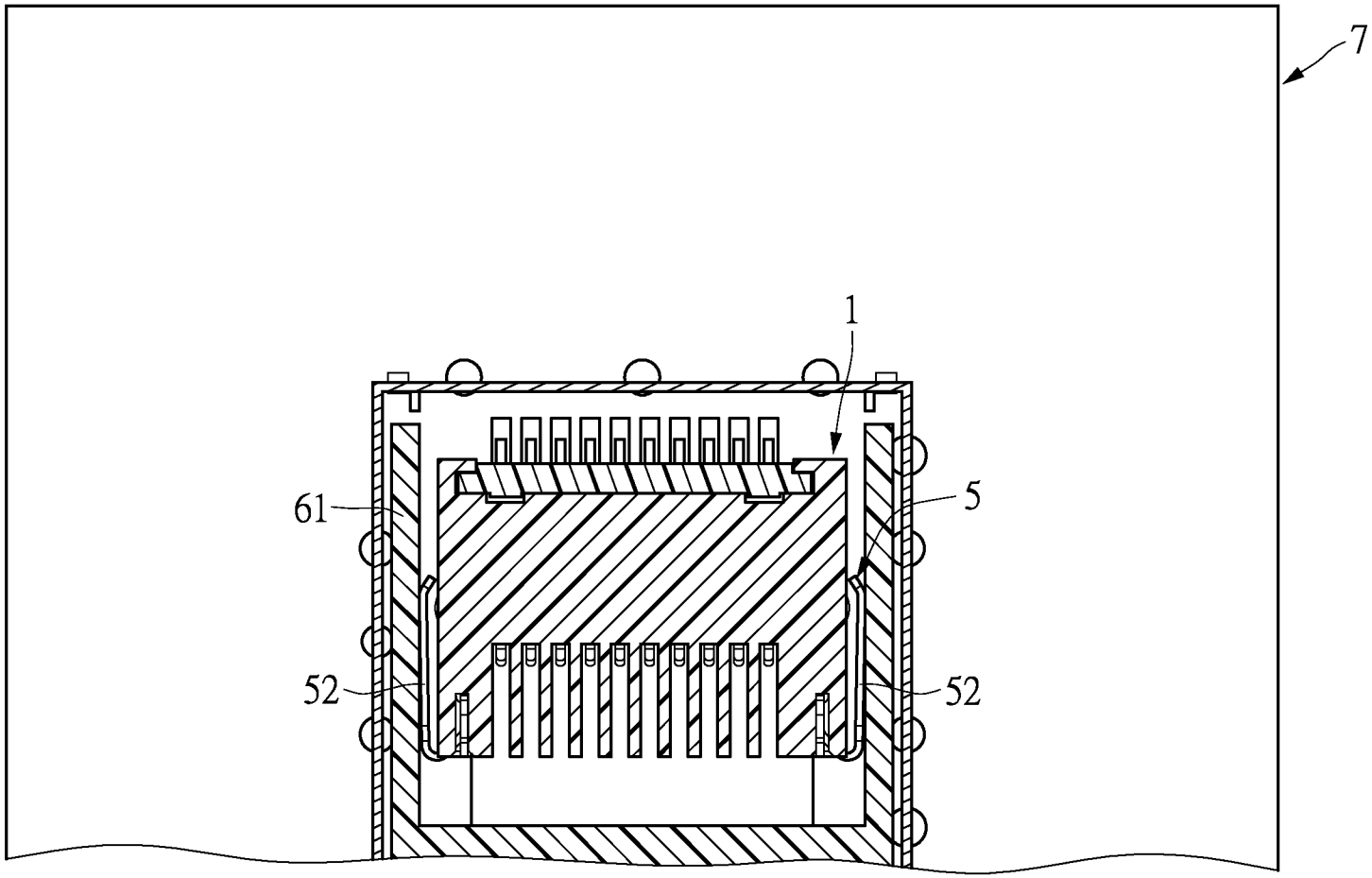
FIG. 9 illustrates a sectional view of a high frequency connector in the instant disclosure connect to a corresponding connector.

The first terminals 2 and the second terminals 3 are disposed in the insulative main body 1. The first terminals 2 and second terminals 3 plug into the second end 2 of the insulative main body 1 and the first end 11 of the insulative main body 1 respectively, so the first terminals 2 and second terminals 3 are accommodated into the terminal slots 15. The first terminals 2 and the second terminals 3 are arranged in the top or bottom side of the terminal slots 15, where the second terminals 3 are located below the first terminals 2. The first terminals 2 and the second terminals 3 are fixed on the insulative main body 1 by the fixed portions 21, 31. One of the ends of the first terminals 2 and second terminals 3 plugs into the terminal slots 15 and electrically connects to a mating plug connector 6 (e.g. optical transceiver) (as shown in FIG. 7-9). Another of the ends of the first terminals 2 and the second terminals 3 are extended outward from the insulative main body 1 and welded on the printed circuit board 7.

The high frequency connector of the present invention further includes a back cover 4 made by insulating material. The length and the height of the back cover 4 are substantially equal to the insulative main body 1. The back cover 4 and the insulative main body 1 can be made of the same material or not be made of the same material. The back cover 4 is installed to the second end 12 of the insulative main body 1 and envelopes the portion of the first terminals 2 protruded from the insulative main body 1 to prevent the first terminals 2 being detached from the insulative main body 1. The soldering portion 23 of the first terminals 2 are projected outward from the back cover 4. An opening 41 is formed in the back cover 4. The back cover 4 is with, but not limited to, a square-shape. The first terminals 2 are provided with the differential signal and extended through the opening 41 to reduce crosstalk. The opening 41 is capable of preventing the first terminals 2 from being detached from the insulative main body 1.

In this embodiment, the back cover 4 is installed on the insulative main body 1 by the manner of buckling. Both sides of the second end 12 of the insulative main body 1 are formed with a first clamping portion 17 respectively, and the first clamping portion 17 could be in slot or block form. Both sides of the back cover 4 are formed with a second clamping portion 42 respectively, and the second clamping portion 42 could be in slot or block form. The first clamping portion 17 hooks with the second clamping portion 42, so the back cover 4 is installed to the insulative main body 1. The back cover 4 also could be installed to the insulative main body 1 by the manner of, but not limited to, bonding. The surface of the back cover 4 adjacent the second end 12 of the insulative main body 1 is formed with a plurality of projections 43. The projections 43 are arranged at regular intervals and available to be contacted by the first terminals 2 to fix the first terminals 2.

The grounding member 5 is made by metal or alloy materials (e.g. stainless steel or copper), and is a conductor of electricity. The grounding member 5 includes a body portion 51 and two contact resilient portions 52, where the body portion 51 is bent with a U-shape. The body portion 51 includes a central body 511 and two side arms 512 are formed with two ends of the central body 511 respectively. Two contact resilient portions 52 are formed with the two side arms 512 respectively, namely, the two contact resilient portions 52 are formed with another end of the side arms 512 where the another end of the side arms 512 is far away the central body 511. Two contact resilient portions 52 are disposed outside of the two side arms 512.

The body portion 51 is installed inside the insulative main body 1 and located between the first terminals 2 and the second terminals 3. More specifically, the central body 511 and two side arms 512 are disposed in the back end and both left and right side respectively, and the central body 51 of the body portion 51 is disposed between the first terminals 2 and the second terminals 3. Two side arms 512 of the body portion 51 are disposed on both sides of the first terminals 2 and second terminals 3. Two contact resilient portions 52 are extended outward from the insulative main body 1 and disposed outward to two side arms 13 of the insulative main body 1. The body portion 51 of the grounding member 5 is disposed inside the opening slot 14 of the insulative main body 1. Two side arms 512 of the body portion 51 are formed with an interfering portion 513 to be fixed in the insulative main body 1, so the body portion 51 of the grounding member 5 is steadily fixed to the insulative main body 1.

With reference to FIG. 7-9, the mating plug connector 6 (optical transceiver) has a metal case 61 and spring 62. The spring 62 contacts the metal case 8 of the high frequency connector of the present invention, and the metal case 8 contacts the printed circuit board 7 to form a ground connection. Two contact resilient portions 52 of the grounding member 5 extend outward from the insulative main body 1 and contact the metal case 61 of the mating plug connector 6 to form a ground connection, to provide the function of grounding and increase the contact area of the ground connection, restrain electromagnetic interference, reduce crosstalk, and raise the speed of data transmission. In additional, the high frequency connector of the present invention has a grounding member 5, and two side arms 512 are formed in the body portion 51 of the grounding member 5 to be available to contact the printed circuit board of the mating plug connector 6 (optical transceiver), and to realize the function of positioning and abrasion resistance.

Figure 10A:
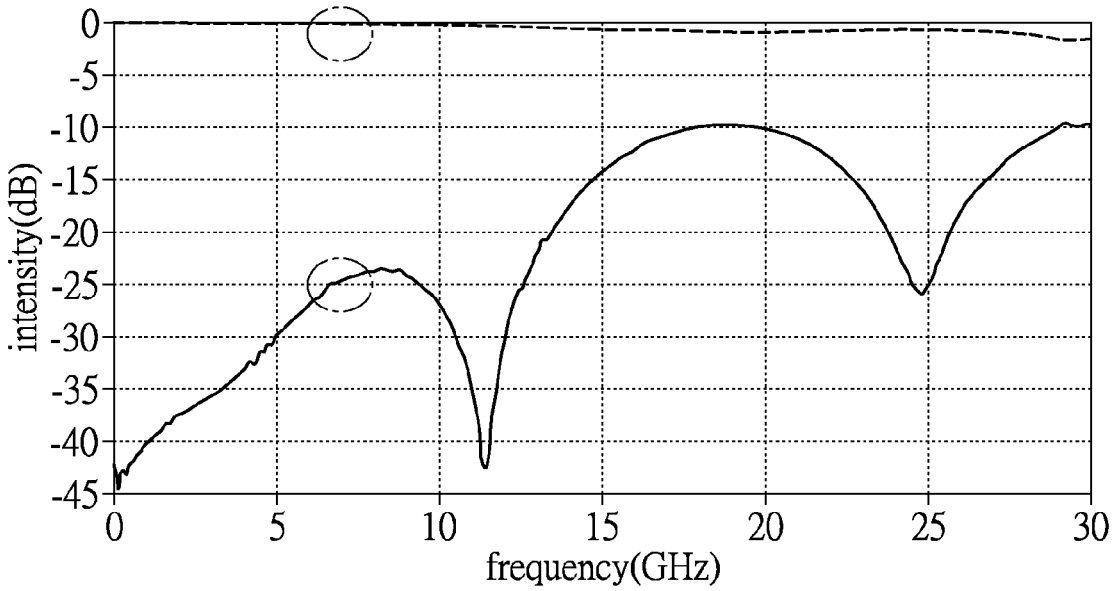
FIG. 10A illustrates a testing connecting and return loss waveform diagram of a high frequency connector in the instant disclosure.
Figure 10B:
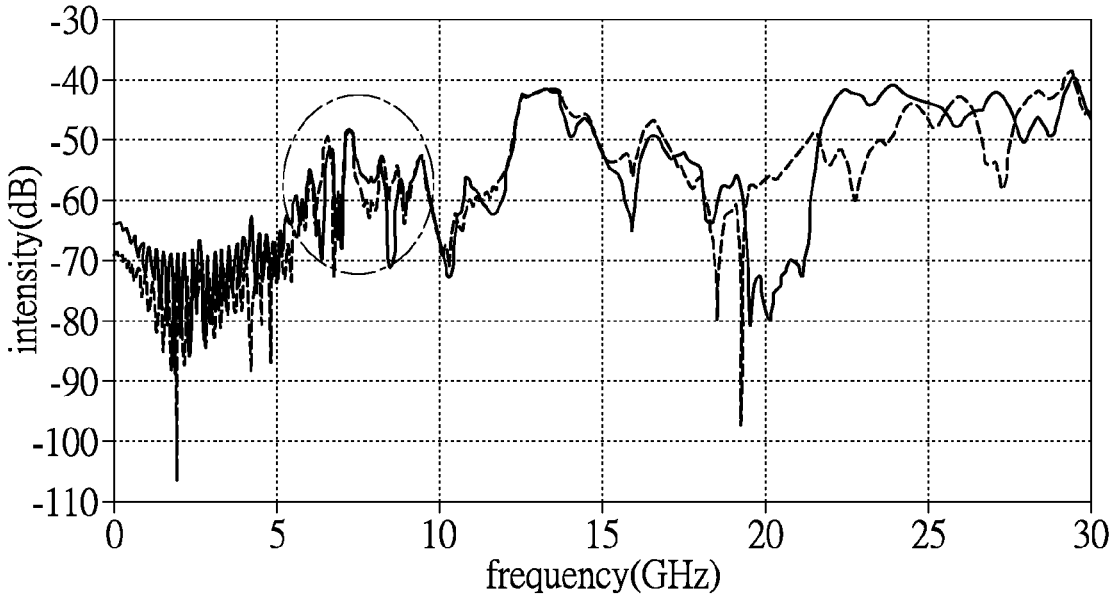
FIG. 10B illustrates a testing crosstalk waveform diagram of a high frequency connector in the instant disclosure.

With reference to FIGS. 10A and 10B, which illustrate a testing connecting and return loss waveform diagram and a testing crosstalk waveform diagram respectively, there is no crosstalk or impulse conditions at 7 GHz.

The descriptions illustrated supra set forth simply the preferred embodiments of the instant disclosure; however, the characteristics of the instant disclosure are by no means restricted thereto. All changes, alterations, or modifications conveniently considered by those skilled in the art are deemed to be encompassed within the scope of the instant disclosure delineated by the following claims.

What is claimed is:

1. A high frequency connector with enhanced grounding for reduced crosstalk, comprising:

an insulative main body having a first end and a second end, a plurality of side walls being disposed between the first end and the second end, the insulative main body being configured with an opening slot and a plurality of terminal slots, the opening slot being configured from the side walls and located between the first end and the second end, the terminal slots respectively being provided at an upper side and a bottom side of the opening slot;

a plurality of first terminals being disposed in the insulative main body and received within the terminal slots;

a plurality of second terminals being disposed in the insulative main body and received within the terminal slots; and a grounding member including a body portion and two contact resilient portions, the body portion configuring a central body and two side arms, each of the side arms respectively being positioned on both ends of the central body, each of the contact resilient portions further extending from the ends of the side arms;

wherein the body portion of the grounding member is disposed inside the insulative main body and centered between the first terminals and the second terminals, and the two contact resilient portions are outstretching from the insulative main body;

wherein the body portion of the grounding member is disposed in the opening slot of the insulative main body;

wherein the central body of the body portion is disposed in the back end of the opening slot, two side arms of the body portion are provided at the right and left side of the opening slot respectively, and two contact resilient portions contact to a metal case of a mating plug connector.

2. The high frequency connector with enhanced grounding for reduced crosstalk according to claim 1, further comprising a back cover disposed in the second end of the insulative main body, the back cover envelopes the first terminal, one end of the first terminals formed with a soldering portion, the soldering portion extends outward from the back cover, and an opening is formed in the back cover.

3. The high frequency connector with enhanced grounding for reduced crosstalk according to claim 1, wherein both sides of the second end of the insulative main body are formed with a first clamping portion respectively, both sides of the back cover formed with a second clamping portion respectively, and the first clamping portion hooks with the second camping portion.

4. The high frequency connector with enhanced grounding for reduced crosstalk according to claim 2, wherein the surface of the back cover adjacent the second end of the insulative main body is formed with a plurality of projections, the projections are arranged at regular intervals and available to be contacted by the first terminals.

5. The high frequency connector with enhanced grounding for reduced crosstalk according to claim 1, wherein the central body of the body portion is disposed between the first terminals and the second terminals.

6. The high frequency connector with enhanced grounding for reduced crosstalk according to claim 1, wherein the two contact resilient portions are formed with one end of two side walls respectively, and the two contact resilient portions are disposed on the outside of the side walls of the insulative main body.

7. The high frequency connector with enhanced grounding for reduced crosstalk according to claim 1, wherein the grounding member is made of metal.

* * * * *